US008317941B2

(12) United States Patent
Kuniyoshi et al.

(10) Patent No.: US 8,317,941 B2
(45) **Date of Patent: *Nov. 27, 2012**

(54) R-T-B-TYPE SINTERED MAGNET AND METHOD FOR PRODUCTION THEREOF

(75) Inventors: Futoshi Kuniyoshi, Osaka (JP); Rintaro Ishii, Osaka (JP)

(73) Assignee: Hitachi Metals, Ltd., Tokyo (JP)

( * ) Notice: Subject to any disclaimer, the term of this patent is extended or adjusted under 35 U.S.C. 154(b) by 190 days.

This patent is subject to a terminal disclaimer.

(21) Appl. No.: 12/935,318

(22) PCT Filed: Mar. 30, 2009

(86) PCT No.: PCT/JP2009/001448

§ 371 (c)(1),
(2), (4) Date: Sep. 29, 2010

(87) PCT Pub. No.: WO2009/122709

PCT Pub. Date: Oct. 8, 2009

(65) Prior Publication Data

US 2011/0025440 A1 Feb. 3, 2011

(30) Foreign Application Priority Data

Mar. 31, 2008 (JP) ..... 2008-089914

(51) Int. Cl.
*H01F 1/057* (2006.01)

(52) U.S. Cl. ..... 148/302; 75/244

(58) Field of Classification Search ..... None
See application file for complete search history.

(56) References Cited

U.S. PATENT DOCUMENTS

| | | | | |
|---|---|---|---|---|
| 4,792,368 | A | 12/1988 | Sagawa et al. | |
| 4,840,684 | A | 6/1989 | Fujimura et al. | |
| 5,858,123 | A * | 1/1999 | Uchida et al. | 148/302 |
| 6,045,629 | A | 4/2000 | Hasegawa et al. | |
| 8,092,619 | B2 * | 1/2012 | Kuniyoshi et al. | 148/302 |
| 2004/0189426 | A1 | 9/2004 | Hidaka et al. | |
| 2006/0213583 | A1 | 9/2006 | Nakamura et al. | |
| 2006/0231165 | A1 | 10/2006 | Kato et al. | |

FOREIGN PATENT DOCUMENTS

| | | | |
|---|---|---|---|
| JP | 04-007804 | A | 1/1992 |
| JP | 2000-219942 | A | 8/2000 |

(Continued)

OTHER PUBLICATIONS

Machine Translation of JP 2005-136015, May 25, 2005.*

(Continued)

*Primary Examiner* — John Sheehan
(74) *Attorney, Agent, or Firm* — Keating & Bennett, LLP

(57) ABSTRACT

An R-T-B based sintered magnet according to the present invention has a composition including: 27.3 mass % to 29.5 mass % of R; 0.92 mass % to 1 mass % of B; 0.05 mass % to 0.3 mass % of Cu; 0.02 mass % to 0.5 mass % of M; and T as the balance, and has an oxygen content of 0.02 mass % to 0.2 mass %. The main phase of the sintered magnet is an $R_2T_{14}B$ type compound. The crystal grain size of the main phase is represented by an equivalent circle diameter of 8 μm or less. And crystal grains with equivalent circle diameters of 4 μm or less account for at least 80% of the overall area of the main phase.

5 Claims, 3 Drawing Sheets

FOREIGN PATENT DOCUMENTS

| | | | |
|---|---|---|---|
| JP | 2002-373822 | A | 12/2002 |
| JP | 2004-303909 | A | 10/2004 |
| JP | 2005-136015 | A | 5/2005 |
| JP | 2005-290398 | A | 10/2005 |
| JP | 2006-100847 | A | 4/2006 |
| JP | 2006-270087 | A | 10/2006 |
| JP | 2007-180374 | A | 7/2007 |

OTHER PUBLICATIONS

English translation of Official Communication issued in corresponding International Application No. PCT/JP2009/001448, mailed on Dec. 23, 2010.

Official Communication issued in International Patent Application No. PCT/JP2009/001448, mailed on Jun. 16, 2009.

* cited by examiner

R-T-B-TYPE SINTERED MAGNET AND METHOD FOR PRODUCTION THEREOF

TECHNICAL FIELD

The present invention relates to an R-T-B based sintered magnet with high coercivity, which can be used effectively to make a motor, among other things.

BACKGROUND ART

It is known that the crystal grain size of an $R_2T_4B$ compound (where R is at least one of the rare-earth elements, T is either Fe alone or Fe and Co, and B is boron), which is included as a main phase in an R-T-B based sintered magnet, is one of the factors that determine the performance of the magnet. And it is generally known that the coercivity can be increased by reducing the size of crystal grains in the sintered magnet.

However, if the size of finely pulverized powder particles (i.e., the diameter of the powder particles) were reduced to decrease the size of crystal grains in a sintered magnet, then the overall surface area of the powder particles would increase, and therefore, the amounts of impurities such as oxygen to be adsorbed onto the surface of the particles would also increase. In such a situation, a part of a rare-earth element R included in the material alloy would react to that oxygen and would be consumed to produce an oxide. As a result, the mole fraction of the rare-earth element R (which will be referred to herein as an "R mole fraction") would be short of the required level. With such an insufficient R mole fraction, a liquid phase (i.e., an R-rich phase) would not be produced smoothly, even though such a liquid phase must be produced to advance the sintering process. To overcome such a problem, however, there is no choice but to increase the R mole fraction in the material alloy too much to avoid a decrease in remanence. That is why even if the pulverized powder particle size were simply decreased, a high-performance magnet could not still be produced.

On top of that, if the overall surface area of a powder compact increased as the finely pulverized powder particle size decreases, then the interfacial energy would increase so much that an abnormal grain growth would arise easily during the sintering process, thus making it difficult to obtain a sintered magnet that has a desired uniform and fine texture. Consequently, high coercivity cannot be achieved just by decreasing the finely pulverized powder particle size.

Patent Document No. 1 shows the relation between the crystal grain size and the performance of a magnet (see FIGS. 3 and 4, in particular), and says that the coercivity increases most significantly at a crystal grain size of around 3 to 5 μm.

Patent Document No. 2 discloses how the coercivity is affected by the addition of various elements, and says that great coercivity can be achieved by adding Mo or Hf when the main phase crystal grains have a size of 5 to 20 μm.

As to the technique of reducing the size of main phase crystal grains of a sintered body, however, both of these patent documents just teach pulverizing the material alloy to a target particle size using a ball mill. To reduce the size of the pulverized powder particles sufficiently by such a known pulverization method, the pulverization process should be carried out either for a long time or a number of times repeatedly with the media changed as needed. In any case, the amounts of impurities will naturally increase and a composition with a high R mole fraction cannot help being adopted. For that reason, the method disclosed in Patent Document No. 1 or 2 cannot be used to make a high-performance magnet.

Patent Document No. 3 discloses that a different phase such as a rare-earth oxide or carbide will check the growth of crystal grains during sintering (i.e., the production of crystal grains with excessively large sizes). However, as such a different phase that will not contribute to improving the magnetic properties must be used according to such a method, the remanence will decrease inevitably, and therefore, it is difficult to apply such a method to making a high-performance magnet.

Patent Document No. 4 discloses a technique for increasing the coercivity without using Tb or Dy by adjusting the crystal grain size of a sintered magnet within a particular range. According to such a technique, however, the increase in crystal grain size is minimized using oxygen that is an impurity. That is why it is also difficult to achieve high remanence, or make a high-performance magnet, by such a technique.

Patent Documents Nos. 5 and 6 disclose a technique for reducing the size of the main phase crystal grains of a sintered magnet by using an additive element such as Nb or Zr, and says that the magnet can be magnetized more easily as a result. According to such a method, the coercivity can be certainly increased sufficiently with the abnormal grain growth minimized during the sintering process. However, as a compound phase that will not contribute to improving the magnetic properties is included in the magnet, the remanence should naturally decrease, and the performance of the magnet can be improved only to a limited degree.

Patent Document No. 7 discloses a technique for reducing the particle size of the powder obtained by a pulverization process with the amounts of oxygen and other impurities minimized and for performing a sintering process at a low temperature without compacting the sintered body using a die. However, Patent Document No. 7 does not mention at all a specific means for pulverizing the powder to the particle size disclosed using a jet mill without increasing the amounts of impurities such as oxygen. Furthermore, Patent Document No. 7 does disclose the amount of oxygen in the finely pulverized powder but does not disclose the composition of the sintered magnet or the amounts of impurities such as oxygen. According to the technique disclosed in Patent Document No. 7, the finely pulverized powder is not compacted with a press machine but is just loaded into a container to a predetermined density and then sintered as it is. That is why to advance the sintering process at a low temperature, a lot of liquid phase components are needed at the sintering temperature. As a result, a lot of rare-earth element R (such as 31.5 mass % of Nd as mentioned in specific examples of Patent Document No. 7) must be used, and such a technique cannot be used to make a high-performance magnet. On top of that, as a lot of liquid phases are generated during the sintering process, the sintering process could be promoted too much to avoid the abnormal grain growth of the sintered texture even if the sintering temperature is lowered.

Patent Document No. 1: Japanese Patent Application Laid-Open Publication No. 59-163802

Patent Document No. 2: Japanese Patent Application Laid-Open Publication No. 59-211558

Patent Document No. 3: Japanese Patent Application Laid-Open Publication No. 4-7804

Patent Document No. 4: Japanese Patent Application Laid-Open Publication No. 2004-303909

Patent Document No. 5: Japanese Patent Application Laid-Open Publication No. 2005-197533

Patent Document No. 6: Japanese Patent Application Laid-Open Publication No. 2006-100847

Patent Document No. 7: Japanese Patent Application Laid-Open Publication No. 2007-180374

DISCLOSURE OF INVENTION

Problems to be Solved by the Invention

Lately, considering various environmental, energy and natural resources related issues, demands for high-performance magnets are increasing day after day. Meanwhile, to make an R-T-B based sintered magnet representative of such high-performance magnets, there is no choice but to count on the supply of a rare-earth element, which is one of its main ingredients, from only limited districts on the earth. On top of that, to make an R-T-B based sintered magnet with high coercivity, at least one of Tb and Dy, which are even rarer and even more expensive among those rare-earth elements, should be used a lot. That is why people are making every effort to use those rare and valuable natural resources in as small an amount as possible.

As described above, it is obvious to those skilled in the art that the coercivity of an R-T-B based sintered magnet should be increased if the crystal grain size of the $R_2T_{14}B$ compound, which is its main phase, could be reduced. However, no one has ever developed a technique for reducing the crystal grain size sufficiently while maintaining high remanence.

According to the conventional methods for reducing the powder particle size unnaturally by adjusting the condition of a known pulverization process that uses a ball mill, for example, the content of oxygen in the powder should increase. On top of that, when a wet pulverization process is performed, the alloy powder might react to the solvent and the pulverization medium worn out could collect impurities so much as to decrease the percentage of the main phase in the sintered magnet. Furthermore, even if a fine material alloy powder with high purity could be obtained, the abnormal grain growth could arise during the sintering process to increase the grain size excessively. In that case, high coercivity would not be achieved after all.

It is therefore an object of the present invention to provide an R-T-B based sintered magnet that can have its crystal grain size reduced easily, has small amounts of impurities, and can have its coercivity increased with the abnormal grain growth minimized and with desired high remanence maintained and also provide a method for producing such a magnet.

Means for Solving the Problems

An R-T-B based sintered magnet according to the present invention has a composition including: 27.3 mass % to 29.5 mass % of R, which is at least one of the rare-earth elements that include Y and of which at least 50 mass % is Pr and/or Nd; 0.92 mass % to 1 mass % of B; 0.05 mass % to 0.3 mass % of Cu; at most 0.5 mass % (including 0 mass %) of M, which is one, two, or more elements that are selected from the group consisting of Al, Ti, V, Cr, Mn, Ni, Zn, Ga, Zr, Nb, Mo, Ag, In, Sn, Hf, Ta, W, Au, Pb and Bi; and T as the balance, which is Fe with or without Co and of which at least 50 mass % is Fe, and has an oxygen content of 0.02 mass % to 0.2 mass %. The main phase of the sintered magnet is an $R_2T_{14}B$ type compound. The crystal grain size of the main phase is represented by an equivalent circle diameter of 8 μm or less. And crystal grains with equivalent circle diameters of 4 μm or less account for at least 80% of the overall area of the main phase.

A method according to the present invention is a method for producing an R-T-B based sintered magnet that has a composition including: 27.3 mass % to 29.5 mass % of R, which is at least one of the rare-earth elements that include Y and of which at least 50 mass % is Pr and/or Nd; 0.92 mass % to 1 mass % of B; 0.05 mass % to 0.3 mass % of Cu; at most 0.5 mass % (including 0 mass %) of M, which is one, two, or more elements that are selected from the group consisting of Al, Ti, V, Cr, Mn, Ni, Zn, Ga, Zr, Nb, Mo, Ag, In, Sn, Hf, Ta, W, Au, Pb and Bi; and T as the balance, which is Fe with or without Co and of which at least 50 mass % is Fe, and that has an oxygen content of 0.02 mass % to 0.2 mass %. The method includes the steps of: providing, as a material alloy, a strip cast alloy, which has an average R-rich phase interval of 4 μm or less in a uniaxial direction; exposing the material alloy to a hydrogen atmosphere, thereby getting the material alloy decrepitated and obtaining a coarse powder; obtaining a fine powder by finely pulverizing the coarse powder so that the fine powder has a particle size represented by a D50 of 3 μm or less as measured by dry jet dispersion laser diffraction analysis and has an oxygen content of 0.2 mass % or less; obtaining a compact by performing a press compaction process on the fine powder under a magnetic field; and sintering the compact by keeping the compact heated to a temperature of 850° C. to 1,000° C. for 4 to 48 hours.

In one preferred embodiment, the step of obtaining the compact includes mixing the fine powder and a saturated hydrocarbon based organic solvent together to obtain a slurry of the fine powder, and the press compaction process is performed on the slurry of the fine powder.

In another preferred embodiment, the step of obtaining the fine powder includes getting the fine pulverization process done by a jet pulverizer using helium or argon gas.

In this particular preferred embodiment, the step of obtaining the fine powder includes achieving a target particle size by using a classifier that is connected to the pulverizer.

Effects of the Invention

An R-T-B based sintered magnet according to the present invention can have increased coercivity while maintaining high remanence. As a result, the sintered magnet can exhibit excellent thermal resistance without being easily demagnetized with heat.

BEST MODE FOR CARRYING OUT THE INVENTION

Figure 1:
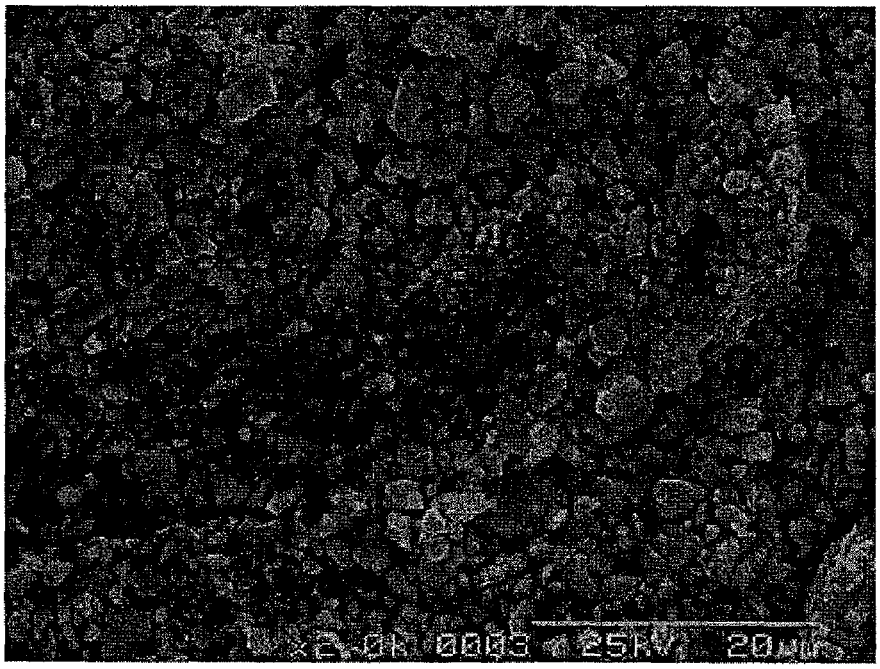
FIG. 1 is a scanning electron microscope (SEM) photograph of a fine powder representing Sample #1 according to a first specific example of the present invention.
Figure 2:
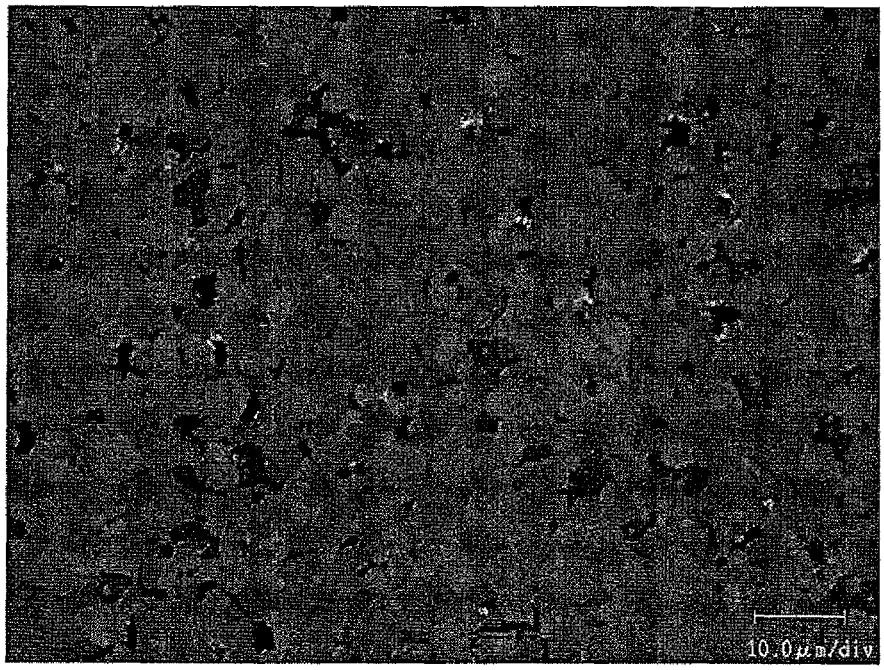
FIG. 2 is a polarizing microscope photograph showing the cross-sectional structure of a sintered body representing Sample #1 according to the first specific example of the present invention.
Figure 3:
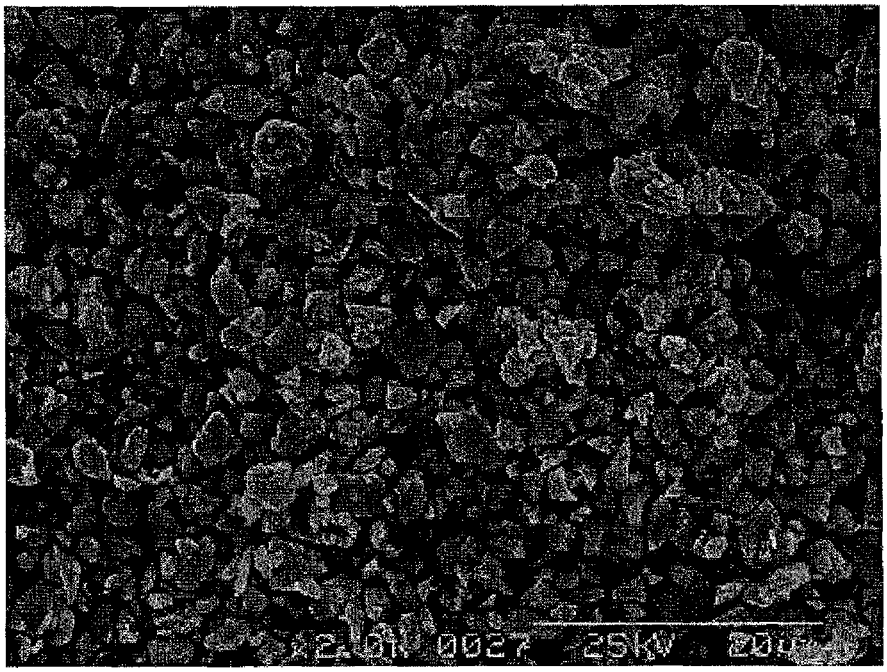
FIG. 3 is an SEM photograph of a fine powder representing Sample #50 according to a third specific example of the present invention.
Figure 4:
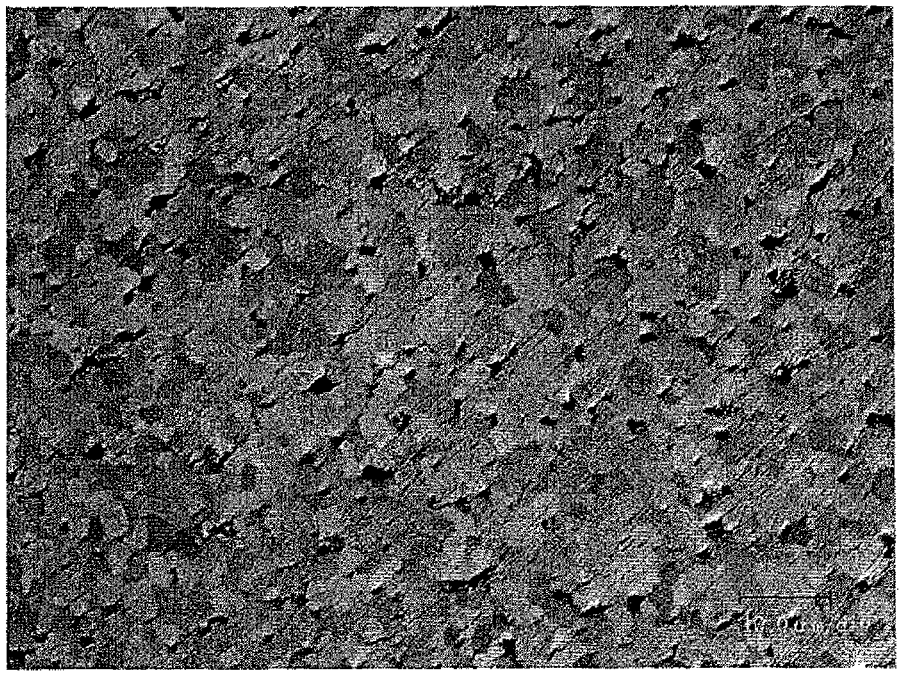
FIG. 4 is a polarizing microscope photograph showing the cross-sectional structure of a sintered body representing Sample #50 according to the third specific example of the present invention.
Figure 5:
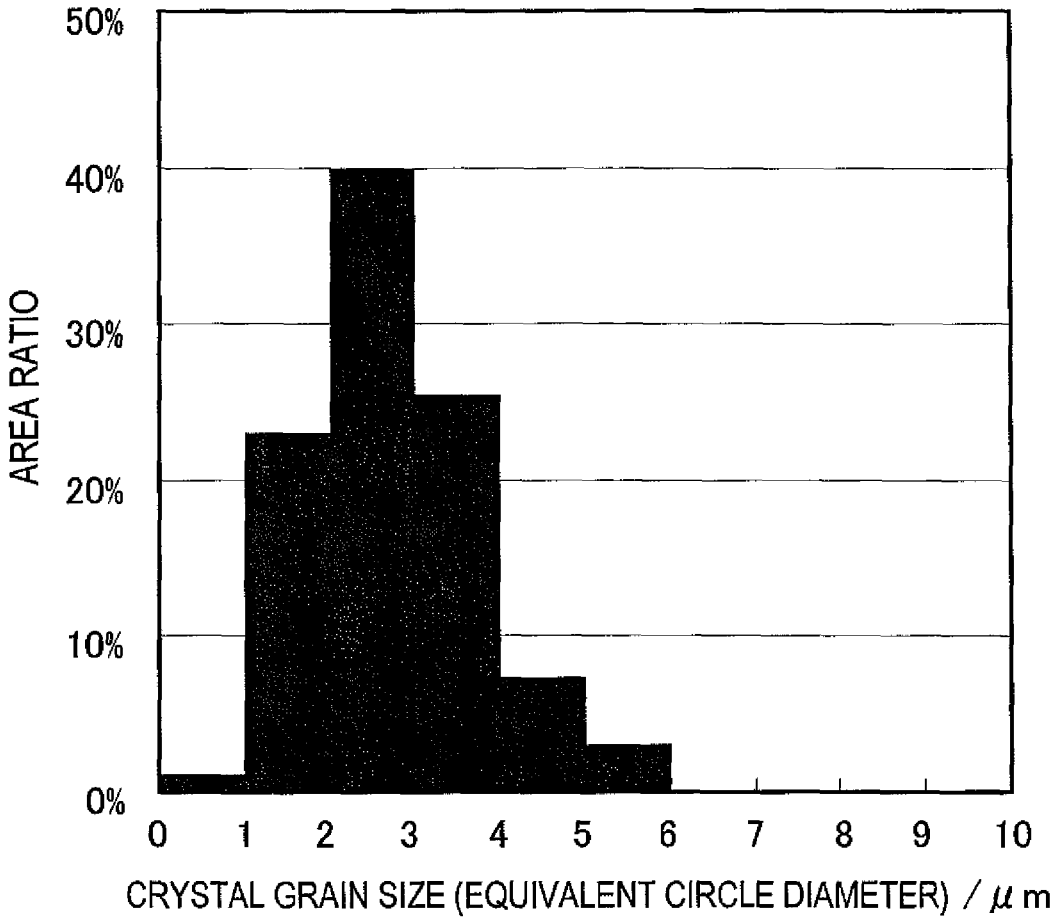
FIG. 5 is a graph showing the distribution of crystal grain sizes that was obtained by observing a cross section of the sintered body representing Sample #50 according to the third specific example of the present invention.

The present inventors researched and developed a technique for increasing the coercivity without decreasing the remanence by not just adding a heavy rare-earth element. As a result, the present inventors discovered that by modifying the metal structure of the material alloy to make a magnet, the load on the pulverization process could be reduced so much that the powder could be easily pulverized to a smaller particle size than conventional ones and the sintered body could have a smaller crystal grain size. On top of that, the present inventors also discovered that a fine powder with high purity could be obtained in that way with the amounts of impurities included reduced significantly, thus perfecting our invention.

According to the present invention, by defining the R mole fraction, the oxygen content and the Cu mole fraction within respective particular ranges, shortage of the liquid phase during the sintering process can be avoided even if the crystal grain size is reduced. As a result, the sintering process can get done at low temperatures and the coercivity can be increased while maintaining high remanence.

The present inventors also discovered that by combining such a method for getting fine pulverization done with the amounts of impurities minimized and a method for getting sintering done without inducing the abnormal grain growth with each other, more significant effects were achieved by defining the composition ranges as described above.

Composition

The magnet of the present invention includes a rare-earth element R, an iron group element T, boron B, an indispensable additive element Cu, an optional additive element M, an impurity O and other inevitably contained impurities.

The rare-earth element R is at least one element that is selected from the rare-earth elements including Y (yttrium). To have the magnet of the present invention achieve good performance, the rare-earth element(s) R preferably accounts for 27.3 mass % to 29.5 mass % of the overall magnet. By defining the (combined) mole fraction of the rare-earth element(s) R within such a range and by adding Cu as will be described later, the shortage of the liquid phase can be avoided even if the size of the crystal grains is reduced. On top of that, the sintering process can get done at low temperatures and the coercivity can be increased as a result with high remanence maintained.

Generally speaking, an R-T-B based magnet includes an $R_2T_{14}B$ type compound as a main phase. And the higher the percentage of the main phase, the higher the performance of such a magnet will be. On the other hand, to achieve high coercivity, it is important to form a phase consisting mostly of R, which is called an "R-rich phase", on the grain boundary of the main phase. Also, a part of R will produce an oxide or a carbide either by itself or in combination with other element(s). That is why in the sintered magnet of the present invention, the lower limit of R is 27.3 mass %, which is slightly greater than the mole fraction of the main phase itself. The reason is as follows. Specifically, if the mole fraction of R were less than 27.3 mass %, then it would be difficult to get sintering done and a bulk body with high density could not be obtained. Also, even if a bulk body could be obtained, the concentration of the R-rich phase would be too low to achieve high coercivity as intended. On the other hand, if the R mole fraction exceeded 29.5 mass %, then the volume percentage of the main phase inside the magnet, and eventually the magnetization of the magnet, would decrease.

Of the rare-earth elements R, the four elements Pr, Nd, Tb and Dy can be used effectively to make the magnet of the present invention. Among other things, Pr or Nd is indispensable to realize a high-performance magnet because Pr or Nd will increase the saturation magnetization of the $R_2T_{14}B$ compound. For that reason, according to the present invention, Pr and/or Nd accounts for 50 mass % or more of R.

Tb and Dy can be used effectively to increase the coercivity of an R-T-B based magnet in general. That is why Tb and Dy can also be added appropriately according to the present invention.

The other rare-earth elements cannot be used effectively on an industrial basis to improve the performance of the magnet. However, any of those elements could also be included in 5 mass % or less because the properties of the magnet will be hardly affected by such a small amount of rare-earth element.

T includes Fe and Co. The magnetization of the $R_2T_{14}B$ type compound is produced mostly by Fe and will hardly decrease even if a small amount of Co is added. Also, Co produces the effects of raising the Curie point of the magnet and improving the grain boundary structure of the magnet and increasing the corrosion resistance thereof, and therefore, can be added according to the intended use. In that case, Fe is supposed to account for 50 mass % or more of T. This is because if Fe accounted for less than 50 mass % of T, the magnetization would decrease significantly.

The indispensable additive element Cu produces a Cu-containing phase, which includes the rare-earth element(s) R as its main ingredient, forms part of the grain boundary phase, and surrounds the main phase in the form of a thin film in the texture of the sintered magnet. The Cu-containing phase structurally matches the main phase, thus increasing the coercivity. Even a very small amount of Cu added will easily diffuse through the main phase to form a thin film there. That is why even if the total percentage of the grain boundary phases, which is determined mainly by the R mole fraction, were very small, it would still contribute effectively to forming magnetic domain walls for the main phase grain boundary, which must be formed to have the sintered magnet exhibit high coercivity. With Cu added, even if the size of the crystal grains were reduced, the liquid phase would never run short and the coercivity could be increased with high remanence maintained.

The minimum required amount of Cu added is 0.05 mass %. This is because if the mole fraction of Cu were less than 0.05 mass %, then naturally the magnetic domain walls would not be formed sufficiently. But before that, it would be extremely difficult to get the sintering process done according to the R mole fraction and sintering temperature condition of the present invention. If the sintering process were carried out without adopting the sintering process conditions of the present invention, a high sintered density could be achieved. In that case, however, the crystal grain size might become too large and the coercivity could decrease significantly at the same time.

Cu can hardly enter the main phase. For that reason, if a lot of Cu were added, the percentage of the main phase, and eventually the magnetization of the magnet, would decrease. For that reason, Cu is preferably added to account for at most 0.3 mass % of the magnet.

Among the additive elements M, Ag, Au and Zn will achieve the same effect as Cu. Ni will also achieve a similar effect. If part or all of Cu is replaced with one, two or more elements selected from the group consisting of Ag, Au, Zn and Ni, the amount of the element added may be determined with the atomic weight ratio taken into account. Specifically, the amounts of Ag, Au, Zn and Ni added should be respectively 1.7, 3.1, 1.03 and 0.92 times as large as Cu.

The element(s) M is/are added to improve the performance of the magnet and to modify the manufacturing process of the magnet. Hereinafter, the effect to be achieved by each of those additive elements and its amount to be added will be described. To achieve high remanence, the total amount of elements M added is preferably 0.5 mass % or less.

Al contributes effectively to improving the physical properties of the grain boundary phase of this magnet and increasing the coercivity thereof. For that reason, Al is preferably added in 0.5 mass % or less. This amount is preferred for the following reasons. Specifically, if the amount of Al added exceeded 0.5 mass %, a lot of Al would enter the main phase and the magnetization of the magnet would decrease significantly, which is not beneficial. Al is included in an Fe—B alloy, which is normally used as a B material. Also, even if an expensive pure B material is separately used to avoid adding Al, at least 0.02 mass % of Al would still be included in the magnet's composition. Furthermore, if a crucible made of an alumina-based material is used to melt the material alloy, Al will also be sometimes included in the magnet, too. Ordinarily, however, the amount of Al added is adjusted in view of the amount introduced from the B material.

When added, Ga will increase the coercivity of the magnet effectively. However, as Ga is expensive, the amount of Ga added is preferably at most 0.5 mass %. On top of that, Ga also achieves the effect of lowering the lower limit of the appropriate range of B added. And such an effect is achieved fully if Ga is added in 0.08 mass % or less.

Ti, V, Cr, Zr, Nb, Mo, Hf, Ta and W achieve the effect of forming a high melting deposition of a boride in the texture and checking the growth of crystal grains during the sintering process. However, those elements will form a deposition that has nothing to do with magnetism and will decrease the magnetization eventually, and therefore, are preferably added in 0.2 mass % or less.

Among these elements, Zr behaves rather differently from the others. Specifically, if the amount of B added is small, Zr will not be deposited in the form of a boride but will still check the grain growth anyway. That is why if 0.1 mass % or less of Zr and 0.98 mass % or less of B are added, the magnetization will not decrease. This is believed to be because Zr is an element that can produce a solid solution in the main phase, too.

Mn is an element that can produce a solid solution in the main phase. And if a lot of Mn were added, the coercivity and the remanence would both decrease. However, Mn and other additive elements M or rare-earth elements may sometimes interact with each other to enhance the effects of the other elements. Mn is preferably added in 0.1 mass % or less.

In, Sn, Pb and Bi will contribute to improving the physical properties of the grain boundary phase and increasing the coercivity of the magnet. However, if these elements were added excessively, then the magnetization of the magnet would decrease. That is why these elements are preferably added in 0.5 mass % or less combined.

B is an indispensable element to form the main phase. The composition ratio of the main phase directly reflects the amount of B added. However, if B were added in more than 1 mass %, then excessive B not contributing to forming the main phase would be produced and would form phases that have nothing to do with magnetic properties. Meanwhile, if B were added in 0.92 mass % or less, then the composition ratio of the main phase would decrease and not only the magnetization of the magnet but also its coercivity would decrease as well. That is why the amount of B added preferably falls within the range of 0.92 mass % to 1 mass %. Nevertheless, if Ga is added in combination, then the upper limit of this preferred range can be 0.98 mass % or less.

The magnet of the present invention also includes other inevitably contained impurities. Among those impurities, the content of oxygen has direct impact on the performance of the magnet. To improve the performance of the magnet, the content of oxygen is preferably reduced as much as possible. However, to reduce the content of oxygen to less than 0.02 mass %, bulky anti-oxidation treatment equipment would be required, which is not beneficial from an industrial point of view. On the other hand, if the content of oxygen exceeded 0.2 mass %, then it would be difficult to get the sintering process done according to the composition of the magnet of the present invention. Also, even if a sintered magnet could be obtained anyway, the performance of that magnet should be low. For these reasons, the content of oxygen is defined to fall within the range of 0.02 mass % to 0.2 mass %. In that case, even if the size of the crystal grains is reduced, the liquid phase will never run short and the sintering process can be done at low temperatures.

Those inevitably contained impurities include C, N, H, Si, Ca, S and P, the contents of which are preferably reduced as much as industrially possible in order to improve the performance of the magnet.

Crystal Grain Size

The crystal grain size of a sintered magnet has impact on the coercivity. Meanwhile, the state of the grain boundary phase also has impact on the coercivity. That is why in the prior art, even if the crystal grain size is just reduced by a conventional technique, high coercivity cannot be achieved. The reason is as follows. Specifically, if the crystal grain size is reduced, the area of the crystal grain boundary will increase, so will the amount of the grain boundary phase required. That is why if the size of the crystal grain boundary is just reduced while using the same composition, then the grain boundary phase will run short. In that case, the increase in coercivity due to the reduction in crystal grain size and the decrease in coercivity due to the shortage of the grain boundary phase will cancel each other. As a result, the effect that should have been achieved by reducing the crystal grain size has actually not been achieved fully so far.

On the other hand, according to the present invention, by defining preferred R mole fraction, oxygen content, and Cu mole fraction, in particular, the grain boundary phase will never run short even if the size of the crystal grains is reduced. As a result, since the effect to be achieved by the reduction in crystal grain size is achieved fully according to the present invention, the coercivity can be increased with high remanence maintained.

The crystal grain size can be obtained by observing a cross section of the magnet through image processing. In this description, the "crystal grain size" is supposed to be represented by the diameter of a circle that has the same area as a crystal grain observed on the cross-sectional structure of the magnet. Such a diameter will be referred to herein as "equivalent circle diameter" (which is also called "Heywood diameter"). If crystal grains with crystal grain sizes of more than 4 μm are included in an area ratio of 20% or more, then the coercivity will not be increased effectively. Meanwhile, crystal grains, of which the sizes exceed 8 μm, would have been produced due to an abnormal grain growth during the sintering process and the presence of such grains would decrease the coercivity. For that reason, according to the present invention, the crystal grain sizes are represented by equivalent circle diameters of 8 μm, and an area ratio of the crystal grains with equivalent circle diameters of 4 μm or less is 80% or more. As used herein, the "area ratio" is the ratio of the combined area of those crystal grains to the overall area of the main phases, which does not include the grain boundary phases and the other phases.

Performance of Magnet

By satisfying the composition and the crystal grain size defined above, the magnet of the present invention achieves better performance, and significantly higher coercivity, among other things, than conventional R-T-B based magnets.

A conventional R-T-B based sintered magnet has had its coercivity increased by replacing a portion of the rare-earth element(s) R with Tb or Dy. However, in a situation where a portion of R is replaced with Tb or Dy, the greater the percentage of R replaced, the lower the remanence will be. That is to say, a tradeoff is inevitable between $H_{cJ}$ and $B_r$ in the conventional R-T-B based sintered magnets. According to the present invention, however, the magnet has the same composition as, but significantly higher coercivity than, conventional magnets.

By adopting the magnet composition and crystal grain size described above, the magnet of the present invention has such excellent performance that $H_{cJ}$ and $B_r$ satisfy:

$$H_{cJ}[\text{kA/m}]>400+4800\times(1.6-B_r[T])$$

Manufacturing Process

The manufacturing process of the present invention is characterized by combining a technique for pulverizing the material alloy to a smaller size than conventional ones without increasing the amounts of impurities and a technique for getting the sintering process done without producing the abnormal grain growth even if no elements are added in particular for the very purpose of checking the grain growth.

To produce an R-T-B based sintered magnet with magnetic anisotropy, an alloy is generally prepared as a start material and then pulverized into a fine powder. In this case, it is not always efficient to obtain the fine powder by performing a single pulverization process. For that reason, the fine powder is normally obtained by performing the two different pulverization processes, which are usually called a "coarse pulverization process" and a "fine pulverization process", respectively.

Material Alloy

The material alloy is preferably prepared by a process for obtaining a fine structure easily (such as a strip casting process). Such a process is preferred because the pulverization process can get done with much less trouble in that case.

To pulverize the alloy to a smaller size than a conventional process, it is preferred that an alloy that has a fine structure, in which the interval between R-rich phases is 4 μm or less in the shortest direction, be used. As a result of a hydrogen decrepitation process, the R-rich phases will expand and easily crack there. That is why the shorter the R-rich phase interval of the material alloy, the more easily small powder particles can be obtained. According to the strip casting process, a material alloy that has a fine structure with a short R-rich phase interval can be obtained. And if such a material alloy is used, the load (such as the pulverization process time) on the fine pulverization process can be lightened and the powder can be pulverized to a smaller size than conventional ones. Consequently, the size of the crystal grains of the sintered body can be reduced significantly, and a fine powder with higher purity can be obtained with the amounts of impurities reduced. If the material alloy had an R-rich phase interval that is more than 4 μm, excessive load would be imposed on the fine pulverization process, and the amounts of impurities caught during the fine pulverization process would increase, which is not beneficial.

The material alloy to make the magnet of the present invention has a small R mole fraction, and therefore, tends to have a longer R-rich phase interval. For that reason, in the strip casting process, the melt of the material alloy is preferably supplied at a decreased rate to the chill roller so that the alloy flakes obtained by quenching will have a reduced thickness. Also, to make a material alloy with a fine structure, it is also effective to reduce the surface roughness of the chill roller so that the melt and the roller can contact more closely with each other and that the melt is quenched more efficiently. Furthermore, the chill roller is preferably made of Cu or any other material that has good thermal conductivity.

Pulverization

The pulverization is supposed to be done in the two processes of coarse pulverization and fine pulverization as described above. It is necessary to manage the amounts of impurities in each of those two processes.

The material alloy is preferably coarsely pulverized by hydrogen decrepitation process, which is a process for producing very small cracks in the alloy by taking advantage of its volume expansion due to hydrogen occlusion and thereby pulverizing the alloy. In the alloy of the present invention, the cracks are produced due to a difference in the rate of occluding hydrogen between the main phase and the R-rich phase (i.e., a difference in their volume variation). That is why according to the hydrogen decrepitation process, the main phase is more likely to crack on the grain boundary.

In a hydrogen decrepitation process, normally the material alloy is exposed to pressurized hydrogen for a certain period of time at an ordinary temperature. Next, the alloy is heated to a raised temperature to release excessive hydrogen and then cooled. The coarse powder obtained by such a hydrogen decrepitation process has a huge number of internal cracks and a significantly increased specific surface. That is why the coarse powder is so active that a lot more oxygen would be absorbed when the powder is handled in the air. For that reason, the powder is preferably handled in an inert gas such as nitrogen or Ar gas. On top of that, as nitrification reaction could also occur at high temperatures, it is preferred that the coarse powder be handled in an Ar atmosphere if some increase in manufacturing cost could be afforded.

As the fine pulverization process, dry pulverization may be carried out using a jet pulverizer. In the dry pulverization process, a coarse powder is introduced into a gas that is flowing at high speeds inside a pulverizer (which will be referred to herein as a "pulverization gas") so that particles of the coarse powder will collide against each other and get pulverized finely. As the pulverization gas, nitrogen gas is usually used. According to the present invention, however, a rare gas such as He or Ar gas is used to avoid nitrification. If a light He gas is used, then the flow velocity of the pulverization gas can be increased so much that considerably great pulverization energy can be produced. As a result, the efficiency of pulverization increases significantly and a high purity fine powder, which can be used effectively in the present invention, can be obtained easily.

However, He gas is expensive here in Japan. That is why when used, He gas is preferably circulated with a compressor introduced into the circulation system. Hydrogen gas could also achieve a similar effect but is not preferred from an industrial point of view because the hydrogen gas might explode when mixed with oxygen gas.

It is preferred that the target particle size be obtained by using a pulverizer with a classifier. By increasing the rotational frequency of the classifier, the particle size of the pulverized powder can be reduced. Alternatively, the particle size can also be reduced by raising the pressure of the pulverization gas and increasing the efficiency of pulverization with the shape of the nozzle of the jet pulverizer, through which the pulverization gas is ejected at high speeds, optimized. The various techniques described above could be used in combination as well.

By avoiding nitrification and oxidation as described above while a dry pulverization process is carried out using a jet pulverizer, a high-purity fine powder, which can be used effectively in the present invention, can be obtained.

Alternatively, a wet pulverization process may also be performed. However, to obtain a fine powder that can be used in the present invention using a normal ball mill, the pulverization process should be performed either for a long time or with the ball diameters changed one after another. In that case, the reaction between the material powder and the solvent would advance so much as to increase the amounts of impurities such as oxygen and carbon in the fine powder, which is not beneficial.

On the other hand, with a beads mill for stirring up the given powder at high speeds using balls with a very small diameter, the powder can be pulverized finely in a short time and the influence of impurities can be minimized. That is why a beads mill is preferably used to obtain a fine powder for use in the present invention.

Furthermore, if the material alloy is pulverized in multiple stages (e.g., coarsely pulverized first by a dry process using a jet pulverizer and then finely pulverized by a wet process using a beads mill), then the alloy can be pulverized efficiently in a short time and the amounts of impurities contained in the fine powder can be minimized.

The solvent for use in the wet pulverization process is selected with its reactivity to the material powder, its ability to reduce oxidation, and its removability before the sintering process taken into consideration. For example, an organic solvent (e.g., a saturated hydrocarbon such as isoparaffin, among other things) is preferably used.

According to the present invention, some measure needs to be taken for avoiding absorbing impurities during the fine pulverization process, in particular. For example, when a wet pulverization process is carried out, the powder should not be pulverized for a long time using a ball mill. Alternatively, a beads mill is preferred to a ball mill because with a beads mill, a fine powder with a target particle size can be obtained in a shorter time (i.e., the pulverization can get done in a shorter time) than with a ball mill and the amounts of oxygen and carbon absorbed can be minimized.

Compaction

The size of the fine powder obtained by the method of the present invention is represented by a D50 of 3 μm or less when the particle size is measured by dry jet dispersion laser diffraction. This particle size is smaller than a conventional normal powder particle size. That is why it is rather difficult to load the die with the fine powder and get crystals aligned with an external magnetic field applied. It is also hard to increase the compact density (green density). However, to minimize the amounts of oxygen and carbon absorbed, the use of a lubricant is preferably minimized. A highly volatile lubricant, which can be removed either during the sintering process or even before that, may be selectively used from known ones.

If the use of the lubricant were minimized, however, it would be difficult to get the powder aligned with the magnetic field applied while a compaction process is being performed under the magnetic field. Particularly, as the fine powder has a small particle size according to the present invention, the moment received by each magnetic powder particle while the external magnetic field is applied thereto is so small that the chances of aligning the magnetic powder insufficiently further increase. However, as far as the performance of the magnet is concerned, the increase in coercivity caused by reducing the crystal grain size is more important than the decrease in remanence due to the disturbed orientation.

On the other hand, to increase the degree of magnetic alignment, it is preferred that the fine powder and a solvent be mixed together to make a slurry and then the slurry be compacted under a magnetic field. In that case, considering the volatility of the solvent, a hydrocarbon with a low molecular weight that can be vaporized almost completely in a vacuum at 250° C. or less may be selected for the next sintering process. Among other things, a saturated hydrocarbon such as isoparaffin is preferred. Also, the slurry may also be made by collecting the fine power directly in the solvent.

The pressure to be applied during the compaction process is one of the factors that determine the conditions of the next process step. According to the present invention, the pressuring force should be at least 9.8 MPa and preferably 19.6 MPa or more, and the upper limit thereof is 245 MPa at most, and preferably 147 MPa.

Sintering

The sintering process is supposed to be carried out within either a vacuum or an inert gas atmosphere, of which the pressure is lower than the atmospheric pressure and where the inert gas refers to Ar and/or He gas(es). Such an inert gas atmosphere, of which the pressure is lower than the atmospheric pressure, is preferably maintained by evacuating the chamber with a vacuum pump and introducing the inert gas into the chamber. In that case, either evacuation or introduction of the inert gas may be performed intermittently. Or both the evacuation and the introduction of the inert gas may be carried out intermittently.

To remove sufficiently the solvent that has been used in the fine pulverization process and the compaction process, preferably it is not until a binder removal process is done that the sintering process is started. The binder removal process may be carried out by keeping the compact heated to a temperature of 300° C. or less for 30 minutes to 8 hours either within a vacuum or an inert gas atmosphere, of which the pressure is lower than the atmospheric pressure. The binder removal process could be performed independently of the sintering process but the binder removal process and the sintering process are preferably performed continuously to increase the efficiency of the process and reduce the oxidation as much as possible. The binder removal process is preferably carried out within an inert gas atmosphere, of which the pressure is lower than the atmospheric pressure, in order to get the binder removal process done as efficiently as possible.

In the sintering process, the compact is seen to release a gas while having its temperature raised. The gas released is mostly the hydrogen gas that has been introduced during the coarse pulverization process. It is not until the hydrogen gas is released that the liquid phase is produced. That is why to release the hydrogen gas completely, the compact is preferably kept heated to a temperature of 700° C. to 850° C. for 30 minutes to 4 hours.

The compact is supposed to be sintered at a temperature of 850° C. to 1,000° C. This temperature range is preferred for the following reasons. Specifically, if the sintering process temperature is lower than 850° C., the hydrogen gas would not be released sufficiently, the liquid phase would not be produced so much as to advance the sintering reaction smoothly, or in the worst-case scenario, the sintering reaction would not be produced at all according to the composition of the present invention. That is to say, a sintered density of 7.5 $Mgm^{-3}$ or more could not be obtained. On the other hand, if the sintering process temperature were higher than 1,000° C., the abnormal grain growth would advance easily according to the composition of the present invention and the resultant magnet would have decreased coercivity.

The sintering process temperature preferably falls within the preferred range for 4 to 48 hours. The reasons are as follows. Specifically, if the temperature stayed within that preferred range for less than four hours, the compact would not have its density increased sufficiently through the process, and therefore, the desired sintered density of 7.5 $Mgm^{-3}$ or more could not be achieved or the magnet would have decreased remanence. On the other hand, if the sintering temperature stayed within that range for more than 48 hours, the density and the magnetic properties would vary a little but chances of producing crystals with an equivalent circle diameter of more than 8 μm would increase. And if such crystals were produced, the coercivity would decrease. For these reasons, the sintering process is preferably continued for 4 to 48 hours.

It should be noted, however, that in the sintering process, the sintering process temperature does not have to be maintained at a certain temperature falling within that preferred range for that preferred period of time. In other words, the sintering process temperature may be varied within that range. For example, the sintering process temperature could be maintained at 950° C. for first two hours and then maintained at 880° C. for the next four hours. Alternatively, the sintering process temperature may even be gradually lowered from 900° C. to 860° C. in eight hours, instead of being maintained at a particular temperature.

Heat Treatment

After the sintering process is finished, the sintered compact is once cooled to 300° C. or less. After that, the sintered compact is thermally treated within the range of 400° C. to 900° C. to have its coercivity increased. This heat treatment may be either carried out continuously at the same temperature or performed in multiple steps with the temperature varied.

Machining

The magnet of the present invention may be subjected to some ordinary type of machining such as cutting or grinding to obtain a desired shape or size.

Surface Treatment

The magnet of the present invention is preferably subjected to some kind of surface coating treatment for anti-corrosion purposes. Examples of preferred surface coating treatments include Ni plating, Sn plating, Zn plating, vapor deposition of an Al film or an Al-based alloy film, and resin coating.

Magnetization

The magnet of the present invention can be magnetized by an ordinary magnetization method (including application of a pulse magnetic field and application of a static magnetic field). In order to handle the magnet material as easily as possible, the magnet material is usually magnetized by such a method after the magnet material has been arranged to form a magnetic circuit. Naturally, however, the magnet can be magnetized by itself.

EXAMPLES

Example 1

A melt of a material alloy was obtained by mixing together Pr and Nd with a purity of 99.5% or more, Tb and Dy with a purity of 99.9% or more, electrolytic iron and low-carbon ferroboron as main ingredients, along with additive elements (Co and/or M) added as either pure metals or alloys with Fe, and then melting the mixture. The melt thus obtained was quenched by strip casting process, thereby obtaining a plate alloy with a thickness of 0.1 to 0.3 mm.

Next, that alloy was decrepitated with hydrogen in a pressurized hydrogen atmosphere, heated to 600° C. within a vacuum, and then cooled. Thereafter, the alloy was classified with a sieve to obtain a coarse alloy powder with particle sizes of 425 μm or less.

Subsequently, the coarse alloy powder was subjected to a dry pulverization process using a jet mill within a nitrogen gas jet, of which the oxygen concentration was controlled to 50 ppm or less, thereby obtaining an intermediate finely pulverized powder with a particle size D50 of 8 to 10 μm. Next, the intermediate finely pulverized powder was further pulverized finely using a beads mill to obtain a fine powder having a particle size D50 of 2.6 μm or less and an oxygen content of 0.2 mass % or less. This particle size was obtained by drying the slurry that had been produced by the beads mill and then subjecting it to a dry jet dispersion laser diffraction analysis. The beads mill pulverization was carried out for a predetermined period of time using beads with a diameter of 0.8 mm and n-paraffin as a solvent.

Then, the fine powder thus obtained as slurry was compacted under a magnetic field to obtain a compact. In this case, the magnetic field applied was a static magnetic field with a strength of approximately 0.8 $MAm^{-1}$ and the pressure was 147 MPa. The magnetic field application direction and the pressuring direction were perpendicular to each other. Until the pulverized alloy was loaded into a sintering furnace, the alloy was transported within a nitrogen atmosphere as much of the time interval as possible.

Then, the compact thus obtained was sintered at temperature(s) falling within the range of 850° C. to 1,000° C. for 4 to 48 hours with some Ar gas supplied into the vacuum. The sintering process temperature and process time vary according to the composition. In any case, the compact was sintered at a lowest possible temperature selected as long as the sintered density would be 7.5 $Mgm^{-3}$.

The composition of the sintered body thus obtained was analyzed. The results, as well as the R-rich phase interval of the material alloy, are shown in the following Table 1. The analysis was carried out using an ICP. On the other hand, the contents of oxygen, nitrogen and carbon were obtained using a gas analyzer.

According to the results obtained by hydrogen analysis by dissolution method, each of these samples had a hydrogen content of 10 to 30 ppm. Also, besides hydrogen and the other elements shown in Table 1, Si, Ca, La, Ce and so on were sometimes detected. Specifically, Si could have come from a crucible that was used to melt the ferroboron material and the alloy together. Ca, La and Ce could have come from the rare-earth material. And Cr could have come from iron. In any case, it is impossible to eliminate these impurity elements altogether.

The sintered body thus obtained was thermally treated at various temperatures for an hour within an Ar atmosphere and then cooled. The heat treatment was carried out with the temperature varied according to the composition. Also, on some samples, the heat treatment was conducted three times at mutually different temperatures. Then, those samples were machined and then had their magnetic properties ($B_r$ and $H_{cJ}$) measured at room temperature by a B-H tracer.

Meanwhile, a portion of each sample was removed and subjected to a texture observation. To obtain its crystal grain size, a cross section of the sample was polished, observed through an optical microscope, and then the image was analyzed through an image analysis software program, thereby obtaining the distribution of crystal grain sizes. As for the magnetic properties, among those samples with various compositions that had been thermally treated under multiple different conditions, only one of the samples that exhibited the highest coercivity at room temperature was analyzed.

The following Table 2 summarizes the crystal grain size distribution of the magnet, the area ratio of crystals with equivalent circle diameters of less than 4 μm, the area ratio of crystals with equivalent circle diameters of 8 μm or more, the pulverization process time, the fine powder particle size D50, the sintering process temperature, the sintering process time, and the magnetic properties of the samples shown in Table 1.

As can be seen from Table 1, Samples #17 to #20 had a wider R-rich phase interval in the material alloy, imposed a heavier load on the fine pulverization process, and therefore, had an increased oxygen content in the sintered body. As a result, as can be seen from Table 2, those samples exhibited decreased coercivity and their remanence $B_r$ and coercivity $H_{cJ}$ fail to satisfy the relation $$H_{cj}[\mathrm{kA/m^{-1}}]>400+4800\times(1.6-B_r[T])$$

TABLE 1

| | Magnet composition (mass %) | | | | | | | | | | | | | | Material alloy R-rich interval |
|---|---|---|---|---|---|---|---|---|---|---|---|---|---|---|---|
| No. | Pr | Nd | Tb | Dy | Fe | Co | Cu | M:Al | M:Ga | M | B | O | C | N | (μm) |
| 1 | | 29.5 | | | bal. | | 0.05 | 0.10 | | | 0.98 | 0.14 | 0.11 | 0.04 | 2.7 |
| 2 | | 28.9 | | | bal. | | 0.05 | 0.10 | | | 0.99 | 0.11 | 0.10 | 0.03 | 2.9 |
| 3 | | 27.8 | | | bal. | 0.9 | 0.08 | 0.08 | | | 0.98 | 0.16 | 0.10 | 0.04 | 3.4 |
| 4 | | 27.3 | | | bal. | 0.9 | 0.08 | 0.08 | | | 0.98 | 0.12 | 0.09 | 0.04 | 3.4 |
| 5 | 2.5 | 26.2 | | | bal. | 0.9 | 0.08 | 0.10 | | | 0.99 | 0.15 | 0.10 | 0.04 | 3.4 |
| 6 | 4.8 | 24.3 | | | bal. | 0.9 | 0.08 | 0.10 | | | 0.98 | 0.17 | 0.10 | 0.04 | 3.7 |
| 7 | 6.5 | 22.1 | | | bal. | 1.8 | 0.08 | 0.10 | | Mn:0.05 | 0.99 | 0.19 | 0.10 | 0.03 | 3.7 |
| 8 | 8.6 | 20.1 | | | bal. | 1.8 | 0.08 | 0.10 | | Mn:0.05 | 1.00 | 0.17 | 0.10 | 0.03 | 3.5 |
| 9 | 12.7 | 15.9 | | | bal. | 1.8 | 0.10 | 0.10 | | Mn:0.05 | 1.00 | 0.18 | 0.09 | 0.04 | 3.6 |
| 10 | 14.1 | 14.8 | | | bal. | 1.8 | 0.10 | 0.11 | | Mn:0.05 | 0.99 | 0.20 | 0.10 | 0.03 | 3.8 |
| 11 | 6.2 | 22.3 | | 0.5 | bal. | 1.8 | 0.09 | 0.10 | | Mn:0.05 | 0.97 | 0.17 | 0.09 | 0.04 | 3.7 |
| 12 | 6.1 | 22.5 | 0.5 | | bal. | 1.8 | 0.10 | 0.11 | | Mn:0.05 | 0.97 | 0.16 | 0.09 | 0.05 | 3.6 |
| 13 | | 28.1 | | 1.3 | bal. | 1.8 | 0.10 | 0.11 | 0.04 | | 0.94 | 0.12 | 0.09 | 0.04 | 3.2 |
| 14 | | 26.5 | | 3.0 | bal. | 1.8 | 0.12 | 0.10 | 0.08 | | 0.92 | 0.13 | 0.10 | 0.04 | 3.3 |
| 15 | | 23.5 | | 5.0 | bal. | 1.8 | 0.11 | 0.20 | | | 0.97 | 0.12 | 0.10 | 0.04 | 3.5 |
| 16 | | 23.5 | 1.0 | 4.0 | bal. | 1.8 | 0.10 | 0.20 | | | 0.97 | 0.14 | 0.10 | 0.03 | 3.2 |
| 17 | 6.2 | 22.3 | | 0.5 | bal. | 1.8 | 0.10 | 0.10 | | Mn:0.05 | 0.97 | 0.21 | 0.13 | 0.04 | 4.3 |
| 18 | 6.2 | 22.3 | | 0.5 | bal. | | 0.09 | 0.10 | | Mn:0.05 | 0.97 | 0.28 | 0.17 | 0.04 | 4.5 |
| 19 | 6.2 | 22.3 | | 0.5 | bal. | | 0.10 | 0.10 | | Mn:0.05 | 0.98 | 0.30 | 0.23 | 0.05 | 4.8 |
| 20 | 6.2 | 22.3 | | 0.5 | bal. | | 0.10 | 0.10 | | Mn:0.05 | 0.97 | 0.31 | 0.28 | 0.05 | 5.8 |

TABLE 2

| | Fine powder | | | Sintering condition | | Crystal grain size area ratio (%) | | Magnetic properties | | |
|---|---|---|---|---|---|---|---|---|---|---|
| | Primary | Secondary | | | Kept | | | | | |
| No. | D50 (μm) | pulverization process time | D50 (μm) | Temperature (° C.) | sintered for | ≦4 μm | >8 μm | $B_r$ (T) | $H_{cJ}$ ($kAm^{-1}$) | $(BH)_{max}$ ($kJm^{-3}$) |
| 1 | 8.4 | 5 minutes | 2.7 | 980 | 4 hrs. | 85 | 0 | 1.492 | 1138 | 420 |
| 2 | 8.6 | 5 minutes | 2.8 | 980 | 4 hrs. | 88 | 0 | 1.503 | 1096 | 426 |
| 3 | 8.7 | 5 minutes | 2.7 | 980 | 4 hrs. | 89 | 0 | 1.514 | 1078 | 432 |
| 4 | 8.5 | 5 minutes | 2.8 | 940 | 8 hrs. | 84 | 0 | 1.522 | 1055 | 438 |
| 5 | 8.8 | 5 minutes | 2.9 | 940 | 8 hrs. | 84 | 0 | 1.501 | 1115 | 425 |
| 6 | 8.4 | 5 minutes | 2.8 | 940 | 8 hrs. | 86 | 0 | 1.498 | 1122 | 422 |
| 7 | 8.6 | 10 minutes | 2.4 | 880 | 12 hrs. | 88 | 0 | 1.504 | 1126 | 427 |
| 8 | 8.8 | 10 minutes | 2.3 | 880 | 12 hrs. | 88 | 0 | 1.505 | 1130 | 427 |
| 9 | 8.5 | 10 minutes | 2.4 | 880 | 12 hrs. | 88 | 0 | 1.504 | 1132 | 426 |
| 10 | 9.0 | 10 minutes | 2.4 | 880 | 12 hrs. | 87 | 0 | 1.501 | 1129 | 424 |
| 11 | 8.4 | 10 minutes | 2.5 | 880 | 12 hrs. | 86 | 0 | 1.472 | 1232 | 408 |
| 12 | 8.7 | 10 minutes | 2.4 | 880 | 12 hrs. | 87 | 0 | 1.494 | 1298 | 420 |
| 13 | 8.6 | 10 minutes | 2.5 | 860 | 16 hrs. | 90 | 0 | 1.441 | 1352 | 392 |
| 14 | 8.4 | 10 minutes | 2.4 | 860 | 16 hrs. | 89 | 0 | 1.371 | 1733 | 354 |
| 15 | 8.5 | 10 minutes | 2.4 | 860 | 16 hrs. | 91 | 0 | 1.288 | 2162 | 311 |
| 16 | 8.8 | 10 minutes | 2.3 | 860 | 16 hrs. | 89 | 0 | 1.306 | 2384 | 321 |
| 17 | 8.8 | 15 minutes | 2.9 | 950 | 8 hrs. | 89 | 0 | 1.478 | 972 | 411 |
| 18 | 9.0 | 20 minutes | 3.0 | 950 | 8 hrs. | 90 | 0 | 1.471 | 924 | 401 |
| 19 | 8.9 | 40 minutes | 2.8 | 950 | 8 hrs. | 91 | 0 | 1.472 | 897 | 376 |
| 20 | 8.9 | 60 minutes | 2.8 | 950 | 8 hrs. | 88 | 0 | 1.470 | 882 | 364 |

Example 2

A melt of a material alloy was obtained by mixing together Pr and Nd with a purity of 99.5% or more, Tb and Dy with a purity of 99.9% or more, electrolytic iron and pure boron as main ingredients, along with (Co and/or M) added as either pure metals or alloys with Fe, and then melting the mixture. The melt thus obtained was quenched by strip casting process, thereby obtaining a plate alloy with a thickness of 0.1 to 0.3 mm.

Next, that alloy was decrepitated with hydrogen in a pressurized hydrogen atmosphere, heated to 600° C. within a vacuum, and then cooled. Thereafter, the alloy was classified with a sieve to obtain a coarse alloy powder with particle sizes of 425 μm or less.

Subsequently, the coarse alloy powder was subjected to a dry pulverization process using a jet mill with a rotary classifier within an Ar gas jet. In this process step, the rotational frequency of the classifier was varied and the pressure of the pulverization gas was set to be 0.98 MPa, which is higher than a normal pulverization gas pressure of 0.58 to 0.69 MPa, thereby obtaining a fine powder with a particle size D50 of 2.8 μm or less and an oxygen content of 0.2 mass % or less. This particle size was obtained by dry jet dispersion laser diffraction analysis.

Then, the fine powder thus obtained was compacted under a magnetic field within a nitrogen atmosphere to obtain a compact. In this case, the magnetic field applied was a static magnetic field with a strength of approximately 1.2 $MAm^{-1}$ and the pressure was 147 MPa. The magnetic field application direction and the pressuring direction were perpendicular to each other. Until the pulverized alloy was loaded into a sintering furnace, the alloy was transported within a nitrogen atmosphere as much of the time interval as possible.

Then, the compact thus obtained was sintered at temperature(s) falling within the range of 850° C. to 1,000° C. for 4 to 48 hours with some Ar gas supplied into the vacuum. The sintering process temperature and process time vary according to the composition. In any case, the compact was sintered at a lowest possible temperature selected as long as the sintered density would be 7.5 $Mgm^{-3}$.

The composition of the sintered body thus obtained was analyzed. The results, as well as the R-rich phase interval of the material alloy, are shown in the following Table 3. The analysis was carried out using an ICP. On the other hand, the contents of oxygen, nitrogen and carbon were obtained using a gas analyzer.

According to the results obtained by hydrogen analysis by dissolution method, each of these samples had a hydrogen content of 10 to 30 ppm.

Also, besides hydrogen and the other elements shown in the table, Si, Ca, La, Ce and so on were sometimes detected. Specifically, Si could have come from a crucible that was used to melt the ferroboron material and the alloy together. Ca, La and Ce could have come from the rare-earth material. And Cr could have come from iron. In any case, it is impossible to eliminate these impurity elements altogether.

The sintered body thus obtained was thermally treated at various temperatures for an hour within an Ar atmosphere and then cooled. The heat treatment was carried out with the temperature varied according to the composition. Also, on some samples, the heat treatment was conducted three times at mutually different temperatures. Then, those samples were machined and then had their magnetic properties ($B_r$ and $H_{cJ}$) measured at room temperature by a B-H tracer.

Meanwhile, a portion of each sample was removed and subjected to a texture observation. To obtain its crystal grain size, a cross section of the sample was polished, observed through an optical microscope, and then the image was analyzed through an image analysis software program, thereby obtaining the distribution of crystal grain sizes. As for the magnetic properties, among those samples with various compositions that had been thermally treated under multiple different conditions, only one of the samples that exhibited the highest coercivity at room temperature was analyzed.

The following Table 4 summarizes the crystal grain size distribution of the magnet, the area ratio of crystals with equivalent circle diameters of less than 4 μm, the area ratio of crystals with equivalent circle diameters of 8 μm or more, the pulverization process time, the fine powder particle size D50, the sintering process temperature, the sintering process time, and the magnetic properties of the samples shown in Table 3.

As can be seen from Table 3, Samples #34 to #40 had R, M:Cu, and B mole fractions that were larger and smaller than their predetermined values. As can be seen from Table 4, the remanence $B_r$ and coercivity $H_{cJ}$ of those samples fail to satisfy the relation $$H_{cJ}[\mathrm{kA/m^{-1}}]>400+4800\times(1.6-B_r[T])$$

TABLE 3

| | Magnet composition (mass %) | | | | | | | | | | | | | | Material alloy R-rich interval |
|---|---|---|---|---|---|---|---|---|---|---|---|---|---|---|---|
| No. | Pr | Nd | Tb | Dy | Fe | Co | Cu | M:Al | M:Ga | M | B | O | C | N | (μm) |
| 21 | | 29.5 | | | bal. | 1.8 | 0.05 | | | | 0.98 | 0.16 | 0.05 | 0.03 | 2.8 |
| 22 | | 28.6 | | | bal. | 1.8 | 0.05 | | | | 0.99 | 0.15 | 0.04 | 0.02 | 3.4 |
| 23 | | 27.3 | | | bal. | 1.8 | 0.05 | | | | 0.98 | 0.15 | 0.05 | 0.03 | 3.6 |
| 24 | | 28.8 | | | bal. | | 0.10 | 0.20 | | | 0.96 | 0.18 | 0.05 | 0.04 | 3.6 |
| 25 | | 28.2 | | 0.7 | bal. | 4.5 | 0.10 | 0.20 | 0.08 | Zr:0.05 | 0.94 | 0.14 | 0.05 | 0.04 | 3.4 |
| 26 | | 28.2 | | 0.7 | bal. | 4.5 | 0.10 | 0.20 | 0.08 | Zr:0.01 | 0.94 | 0.15 | 0.00 | 0.03 | 3.4 |
| 27 | | 28.2 | | 0.7 | bal. | 6.3 | 0.10 | 0.20 | 0.15 | Mn:0.05 | 0.94 | 0.13 | 0.06 | 0.04 | 3.6 |
| 28 | 5.8 | 22.7 | | 1.0 | bal. | 0.9 | 0.20 | 0.15 | | Sn:0.1 | 0.99 | 0.12 | 0.05 | 0.02 | 2.8 |
| 29 | 5.8 | 22.7 | | 1.0 | bal. | 0.9 | 0.20 | 0.15 | | Nb:0.2 | 1.00 | 0.12 | 0.06 | 0.03 | 2.7 |
| 30 | 5.8 | 22.7 | | 1.0 | bal. | 0.9 | 0.15 | 0.15 | | Cr:0.02 | 0.99 | 0.13 | 0.06 | 0.04 | 3.1 |
| 31 | 5.7 | 22.8 | | 1.0 | bal. | 0.9 | 0.15 | 0.15 | | Mo:0.2 | 0.99 | 0.13 | 0.04 | 0.04 | 3.1 |
| 32 | 5.7 | 22.8 | | 1.0 | bal. | 0.9 | 0.05 | 0.15 | | Ag:0.05 | 1.00 | 0.12 | 0.04 | 0.02 | 3.2 |
| 33 | 5.5 | 23.0 | 1.0 | | bal. | 0.9 | 0.10 | 0.20 | | Mn:0.05 | 1.00 | 0.14 | 0.04 | 0.03 | 3.1 |
| 34 | | 30.5 | | | bal. | | 0.10 | 0.20 | | | 0.98 | 0.18 | 0.04 | 0.03 | 2.9 |
| 35 | | 27.0 | | | bal. | | 0.10 | 0.20 | | | 0.98 | 0.09 | 0.06 | 0.03 | 3.8 |
| 36 | | 29.4 | | | bal. | | 0.02 | 0.01 | | | 0.97 | 0.11 | 0.06 | 0.02 | 3.8 |
| 37 | | 27.5 | | | bal. | | 0.02 | 0.01 | | | 0.97 | 0.12 | 0.05 | 0.03 | 3.6 |
| 38 | 6.4 | 22.9 | | | bal. | 0.9 | 0.34 | 0.52 | | | 0.98 | 0.11 | 0.05 | 0.03 | 3.7 |

TABLE 3-continued

| | Magnet composition (mass %) | | | | | | | | | | | | | | Material alloy R-rich interval |
|---|---|---|---|---|---|---|---|---|---|---|---|---|---|---|---|
| No. | Pr | Nd | Tb | Dy | Fe | Co | Cu | M:Al | M:Ga | M | B | O | C | N | (μm) |
| 39 | 6.1 | 23.2 | | | bal. | 0.9 | 0.05 | 0.10 | | | 0.91 | 0.11 | 0.04 | 0.02 | 3.3 |
| 40 | 6.2 | 23.2 | | | bal. | 0.9 | 0.10 | 0.12 | | | 1.02 | 0.13 | 0.05 | 0.02 | 3.5 |

TABLE 4

| | | Sintering condition | | Crystal grain size area ratio (%) | | Magnetic properties | | |
|---|---|---|---|---|---|---|---|---|
| No. | Fine powder D50 (μm) | Temperature (° C.) | Kept sintered for | ≦4 μm | >8 μm | $B_r$(T) | $H_{cJ}$ ($kAm^{-1}$) | $(BH)_{max}$ ($kJm^{-3}$) |
| 21 | 2.8 | 900 | 8 hrs. | 82 | 0 | 1.491 | 1131 | 420 |
| 22 | 2.8 | 900 | 16 hrs. | 85 | 0 | 1.510 | 1122 | 430 |
| 23 | 2.8 | 920 | 48 hrs. | 88 | 0 | 1.523 | 1118 | 438 |
| 24 | 2.9 | 950 | 12 hrs. | 89 | 0 | 1.506 | 1135 | 428 |
| 25 | 2.7 | 950 | 12 hrs. | 91 | 0 | 1.468 | 1271 | 427 |
| 26 | 3.0 | 980 | 12 hrs. | 80 | 0 | 1.470 | 1266 | 426 |
| 27 | 2.9 | 950 | 12 hrs. | 82 | 0 | 1.466 | 1272 | 425 |
| 28 | 3.0 | 950 | 8 hrs. | 81 | 0 | 1.450 | 1335 | 396 |
| 29 | 2.7 | 980 | 8 hrs. | 88 | 0 | 1.451 | 1341 | 396 |
| 30 | 2.8 | 980 | 8 hrs. | 86 | 0 | 1.449 | 1340 | 395 |
| 31 | 2.6 | 980 | 8 hrs. | 93 | 0 | 1.450 | 1338 | 397 |
| 32 | 2.9 | 950 | 8 hrs. | 83 | 0 | 1.451 | 1328 | 397 |
| 33 | 2.8 | 950 | 8 hrs. | 84 | 0 | 1.472 | 1510 | 408 |
| 34 | 2.8 | 920 | 4 hrs. | 78 | 5 | 1.468 | 957 | 392 |
| 35 | 2.8 | 980 | 48 hrs. | 88 | 0 | 1.465 | 573 | 388 |
| 36 | 2.9 | 950 | 8 hrs. | 85 | 0 | 1.491 | 615 | 394 |
| 37 | 2.9 | 950 | 24 hrs. | 85 | 0 | 1.510 | 623 | 375 |
| 38 | 2.8 | 920 | 4 hrs. | 81 | 4 | 1.471 | 952 | 395 |
| 39 | 2.8 | 980 | 8 hrs. | 84 | 0 | 1.478 | 614 | 398 |
| 40 | 2.9 | 950 | 8 hrs. | 82 | 0 | 1.461 | 974 | 401 |

Example 3

A melt of a material alloy was obtained by mixing together Pr and Nd with a purity of 99.5% or more, Tb and Dy with a purity of 99.9% or more, electrolytic iron and pure boron as main ingredients, along with additive elements (Co and/or M) added as either pure metals or alloys with Fe, and then melting the mixture. The melt thus obtained was quenched by strip casting process, thereby obtaining a plate alloy with a thickness of 0.1 to 0.3 mm.

Next, that alloy was decrepitated with hydrogen in a pressurized hydrogen atmosphere, heated to 600° C. within a vacuum, and then cooled. Thereafter, the alloy was classified with a sieve to obtain a coarse alloy powder with particle sizes of 425 μm or less.

Subsequently, the coarse alloy powder was subjected to a dry pulverization process using a jet mill within an He gas jet, thereby obtaining a fine powder having a particle size D50 of 2.8 μm or less and an oxygen content of 0.2 mass % or less. This particle size was obtained by dry jet dispersion laser diffraction analysis.

Then, the fine powder thus obtained was put into a solvent and compacted as a slurry under a magnetic field to obtain a compact. In this case, the magnetic field applied was a static magnetic field with a strength of approximately 1.2 $MAm^{-1}$ and the pressure was 49 MPa. The magnetic field application direction and the pressuring direction were perpendicular to each other. Until the pulverized alloy was loaded into a sintering furnace, the alloy was transported within a nitrogen atmosphere as much of the time interval as possible. As the solvent, n-paraffin was used.

Then, the compact thus obtained was sintered at temperature(s) falling within the range of 850° C. to 1,000° C. for 4 to 48 hours with some Ar gas supplied into the vacuum. The sintering process temperature and process time vary according to the composition. In any case, the compact was sintered at a lowest possible temperature selected as long as the sintered density would be 7.5 $Mgm^{-3}$.

The composition of the sintered body thus obtained was analyzed. The results, as well as the R-rich phase interval of the material alloy, are shown in the following Table 5. The analysis was carried out using an ICP. On the other hand, the contents of oxygen, nitrogen and carbon were obtained using a gas analyzer. According to the results obtained by hydrogen analysis by dissolution method, each of these samples had a hydrogen content of 10 to 30 ppm.

Also, besides hydrogen and the other elements shown in Table 5, Si, Ca, La, Ce and so on were sometimes detected. Specifically, Si could have come from a crucible that was used to melt the ferroboron material and the alloy together. Ca, La and Ce could have come from the rare-earth material. And Cr could have come from iron. In any case, it is impossible to eliminate these impurity elements altogether.

The sintered body thus obtained was thermally treated at various temperatures for an hour within an Ar atmosphere and then cooled. The heat treatment was carried out with the temperature varied according to the composition. Also, on some samples, the heat treatment was conducted three times at mutually different temperatures. Then, those samples were machined and then had their magnetic properties ($B_r$ and $H_{cJ}$) measured at room temperature by a B-H tracer.

Meanwhile, a portion of each sample was removed and subjected to a texture observation. To obtain its crystal grain size, a cross section of the sample was polished, observed through an optical microscope, and then the image was analyzed through an image analysis software program, thereby obtaining the distribution of crystal grain sizes. As for the magnetic properties, among those samples with various compositions that had been thermally treated under multiple different conditions, only one of the samples that exhibited the highest coercivity at room temperature was analyzed.

The following Table 6 summarizes the crystal grain size distribution of the magnet, the area ratio of crystals with equivalent circle diameters of less than 4 μm, the area ratio of crystals with equivalent circle diameters of 8 μm or more, the pulverization process time, the fine powder particle size D50, the sintering process temperature, the sintering process time, and the magnetic properties of the samples shown in Table 5.

In Samples #52 and #53 shown in Table 6, the sintering process temperature was so high that abnormal grain growth was produced and their coercivity was low. Although Sample #55 was obtained at a low sintering process temperature, the sintering process had to be performed for a long time to achieve a sufficient sintered density. As a result, the crystal grains also grew so much that the coercivity decreased. The same can be said about Sample #57, which was also subjected to a long sintering process and had its coercivity decreased due to the abnormal grain growth. As for Samples #59 and #60, their fine pulverization particle size D50 was so large that the sintering process should be done at a high temperature. As a result, their magnetic properties (coercivity, among other things) were insufficient. Consequently, in those Samples, their remanence $B_r$ and coercivity $H_{cJ}$ fail to satisfy the relation $$H_{cJ}[\mathrm{kA/m^{-1}}]>400+4800\times(1.6-B_r[T])$$

Also, the mechanical strength of Samples #50 and #52 shown in Tables 5 and 6 was measured by the four point bend test as defined by JIS R1601. As a result, the strength of Sample #50 turned out to be approximately 1.5 times as high as that of Sample #52.

Samples #50 and #52 were further subjected to a tape strip test (using a cellophane tape with a width of 18 mm) before and after a 80° C., 95% RH test and a PCT (in water vapor at 120° C. and at 2 atmospheric pressure) test to see how their appearance changed. Those samples were also subjected to a 80° C., 90% RH test to see how their weight changed (with moisture absorption and due to oxidation). As a result, the weight of Sample #52 varied with time (from 0 through 250 hours) but that of Sample #50 hardly varied.

TABLE 5

| | Magnet composition (mass %) | | | | | | | | | | | | | | Material alloy R-rich |
|---|---|---|---|---|---|---|---|---|---|---|---|---|---|---|---|
| No. | Pr | Nd | Tb | Dy | Fe | Co | Cu | M:Al | M:Ga | M | B | 0 | C | N | interval (μm) |
| 41 | 5.5 | 22.0 | | 1.0 | bal. | 0.9 | 0.10 | 0.15 | 0.10 | | 0.94 | 0.12 | 0.07 | 0.03 | 3.5 |
| 42 | 5.5 | 22.0 | | 1.0 | bal. | 0.9 | 0.10 | 0.15 | 0.10 | Ni:0.05 | 0.94 | 0.13 | 0.07 | 0.03 | 3.6 |
| 43 | 5.5 | 22.0 | | 1.0 | bal. | 0.9 | 0.10 | 0.15 | 0.10 | Ti:0.1 | 0.94 | 0.11 | 0.06 | 0.04 | 3.4 |
| 44 | 5.5 | 22.0 | | 1.0 | bal. | 0.9 | 0.10 | 0.15 | 0.10 | V:0.1 | 0.94 | 0.11 | 0.06 | 0.03 | 3.3 |
| 45 | 5.5 | 22.0 | | 1.0 | bal. | 0.9 | 0.10 | 0.15 | 0.10 | Hf:0.1 | 0.94 | 0.12 | 0.06 | 0.03 | 3.3 |
| 46 | 5.5 | 22.0 | | 1.0 | bal. | 0.9 | 0.10 | 0.15 | 0.10 | In:0.1 | 0.94 | 0.12 | 0.07 | 0.03 | 3.2 |
| 47 | 5.5 | 22.0 | | 1.0 | bal. | 0.9 | 0.10 | 0.15 | 0.10 | Bi:0.1 | 0.94 | 0.11 | 0.07 | 0.03 | 3.6 |
| 48 | | 27.9 | 0.5 | 0.5 | bal. | 0.9 | 0.10 | 0.15 | 0.10 | | 0.94 | 0.11 | 0.08 | 0.02 | 3.8 |
| 49 | | 28.3 | 0.5 | | bal. | 0.9 | 0.10 | 0.15 | 0.10 | | 0.94 | 0.12 | 0.07 | 0.03 | 3.8 |
| 50 | | 28.2 | | 0.5 | bal. | 0.9 | 0.10 | 0.15 | 0.10 | | 0.94 | 0.10 | 0.07 | 0.03 | 3.5 |
| 51 | | 28.3 | | 0.5 | bal. | 0.9 | 0.10 | 0.15 | 0.10 | | 0.94 | 0.10 | 0.05 | 0.03 | 3.5 |
| 52 | | 28.2 | | 0.5 | bal. | 0.9 | 0.10 | 0.15 | 0.10 | | 0.94 | 0.09 | 0.05 | 0.02 | 3.5 |
| 53 | | 28.2 | | 0.5 | bal. | 0.9 | 0.10 | 0.15 | 0.10 | | 0.94 | 0.11 | 0.06 | 0.02 | 3.5 |
| 54 | | 28.3 | | 0.5 | bal. | 0.9 | 0.10 | 0.15 | | | 0.97 | 0.12 | 0.07 | 0.03 | 3.6 |
| 55 | | 28.3 | | 0.5 | bal. | 0.9 | 0.10 | 0.15 | | | 0.97 | 0.11 | 0.07 | 0.03 | 3.6 |
| 56 | | 28.3 | | 0.5 | bal. | 0.9 | 0.10 | 0.15 | | | 0.97 | 0.11 | 0.05 | 0.03 | 3.6 |
| 57 | | 28.3 | | 0.5 | bal. | 0.9 | 0.10 | 0.15 | | | 0.97 | 0.13 | 0.06 | 0.03 | 3.6 |
| 58 | | 28.3 | | 0.5 | bal. | 0.9 | 0.10 | 0.15 | | | 0.97 | 0.11 | 0.07 | 0.04 | 3.6 |
| 59 | | 28.3 | | 0.5 | bal. | 0.9 | 0.10 | 0.15 | | | 0.97 | 0.12 | 0.06 | 0.04 | 3.6 |
| 60 | | 28.2 | | 0.5 | bal. | 0.9 | 0.10 | 0.15 | | | 0.97 | 0.13 | 0.06 | 0.03 | 3.6 |

TABLE 6

| | | Sintering condition | | Crystal grain size area ratio (%) | | Magnetic properties | | |
|---|---|---|---|---|---|---|---|---|
| No. | Fine powder D50 (μm) | Temperature (° C.) | Kept sintered for | ≦4 μm | >8 μm | $B_r$ (T) | $H_{cJ}$ ($kAm^{-1}$) | $(BH)_{max}$ ($kJm^{-3}$) |
| 41 | 2.8 | 920 | 16 hrs. | 84 | 0 | 1.452 | 1298 | 398 |
| 42 | 3.0 | 920 | 24 hrs. | 86 | 0 | 1.450 | 1302 | 397 |
| 43 | 2.3 | 980 | 4 hrs. | 91 | 0 | 1.450 | 1305 | 397 |
| 44 | 2.3 | 980 | 4 hrs. | 90 | 0 | 1.449 | 1314 | 396 |
| 45 | 2.4 | 980 | 4 hrs. | 88 | 0 | 1.453 | 1331 | 399 |
| 46 | 2.7 | 940 | 16 hrs. | 88 | 0 | 1.451 | 1299 | 397 |
| 47 | 2.8 | 940 | 16 hrs. | 87 | 0 | 1.450 | 1284 | 397 |
| 48 | 2.8 | 960 | 8 hrs. | 88 | 0 | 1.462 | 1398 | 403 |
| 49 | 2.7 | 960 | 4 hrs. | 90 | 0 | 1.485 | 1309 | 415 |
| 50 | 2.2 | 1000 | 4 hrs. | 89 | 0 | 1.478 | 1198 | 412 |
| 51 | 2.2 | 980 | 8 hrs. | 83 | 0 | 1.475 | 1195 | 410 |
| 52 | 2.2 | 1020 | 4 hrs. | 71 | 4 | 1.481 | 934 | 411 |

TABLE 6-continued

| No. | Fine powder D50 (μm) | Sintering condition: Temperature (° C.) | Sintering condition: Kept sintered for | Crystal grain size area ratio (%): ≦4 μm | Crystal grain size area ratio (%): >8 μm | Magnetic properties: $B_r$ (T) | Magnetic properties: $H_{cJ}$ ($kAm^{-1}$) | Magnetic properties: $(BH)_{max}$ ($kJm^{-3}$) |
|---|---|---|---|---|---|---|---|---|
| 53 | 2.2 | 1040 | 2 hrs. | 66 | 6 | 1.483 | 942 | 410 |
| 54 | 2.1 | 850 | 48 hrs. | 88 | 0 | 1.475 | 1188 | 411 |
| 55 | 2.1 | 840 | 60 hrs. | 84 | 2 | 1.484 | 949 | 414 |
| 56 | 2.1 | 980 | 4 hrs. | 91 | 0 | 1.478 | 1202 | 412 |
| 57 | 2.1 | 980 | 60 hrs. | 52 | 12 | 1.482 | 840 | 403 |
| 58 | 2.9 | 980 | 8 hrs. | 87 | 0 | 1.486 | 1190 | 416 |
| 59 | 3.5 | 1060 | 4 hrs. | 62 | 6 | 1.487 | 884 | 407 |
| 60 | 4.6 | 1060 | 4 hrs. | 60 | 4 | 1.490 | 891 | 410 |

INDUSTRIAL APPLICABILITY

An R-T-B based sintered magnet according to the present invention can have increased coercivity while maintaining high remanence. As a result, the magnetization of the magnet hardly decreases even with heat and its thermal resistance increases significantly. That is why the R-T-B based sintered magnet of the present invention can be used effectively to make a motor, in particular.

The invention claimed is:

1. An R-T-B based sintered magnet having a composition comprising:

27.3 mass % to 29.5 mass % of R, which is at least one of the rare-earth elements that include Y and of which at least 50 mass % is Pr and/or Nd;

0.92 mass % to 1 mass % of B;

0.05 mass % to 0.3 mass % of Cu;

at most 0.5 mass % (including 0 mass %) of M, which is one, two, or more elements that are selected from the group consisting of Al, Ti, V, Cr, Mn, Ni, Zn, Ga, Zr, Nb, Mo, Ag, In, Sn, Hf, Ta, W, Au, Pb and Bi; and T as the balance, which is Fe with or without Co and of which at least 50 mass % is Fe, and having an oxygen content of 0.02 mass % to 0.2 mass %, wherein the main phase of the sintered magnet is an $R_2T_{14}B$ type compound, and wherein the crystal grain size of the main phase is represented by an equivalent circle diameter of 8 μm or less and wherein crystal grains with equivalent circle diameters of 4 μm or less account for at least 80% of the overall area of the main phase.

2. A method for producing an R-T-B based sintered magnet having a composition comprising:

27.3 mass % to 29.5 mass % of R, which is at least one of the rare-earth elements that include Y and of which at least 50 mass % is Pr and/or Nd;

0.92 mass % to 1 mass % of B;

0.05 mass % to 0.3 mass % of Cu;

at most 0.5 mass % (including 0 mass %) of M, which is one, two, or more elements that are selected from the group consisting of Al, Ti, V, Cr, Mn, Ni, Zn, Ga, Zr, Nb, Mo, Ag, In, Sn, Hf, Ta, W, Au, Pb and Bi; and T as the balance, which is Fe with or without Co and of which at least 50 mass % is Fe, and having an oxygen content of 0.02 mass % to 0.2 mass %, wherein the method comprises the steps of:

providing, as a material alloy, a strip cast alloy that comprises R-rich phases in which an average interval between the R-rich phases is 4 μm or less;

exposing the material alloy to a hydrogen atmosphere, thereby getting the material alloy decrepitated and obtaining a coarse powder;

obtaining a fine powder by finely pulverizing the coarse powder so that the fine powder has a particle size represented by a D50 of 3 μm or less as measured by dry jet dispersion laser diffraction analysis and has an oxygen content of 0.2 mass % or less;

obtaining a compact by performing a press compaction process on the fine powder under a magnetic field; and sintering the compact by keeping the compact heated to a temperature of 850° C. to 1,000° C. for 4 to 48 hours.

3. The method of claim 2, wherein the step of obtaining the compact includes mixing the fine powder and a saturated hydrocarbon based organic solvent together to obtain a slurry of the fine powder, and wherein the press compaction process is performed on the slurry of the fine powder.

4. The method of claim 2, wherein the step of obtaining the fine powder includes getting the fine pulverization process done by a jet pulverizer using helium or argon gas.

5. The method of claim 4, wherein the step of obtaining the fine powder includes achieving a target particle size by using a classifier that is connected to the pulverizer.

* * * * *